US005340330A

United States Patent [19]

Dolson et al.

[11] Patent Number: 5,340,330

[45] Date of Patent: Aug. 23, 1994

[54] ANTI-KINK CONTROL FOR ELECTRICAL CORDS

[75] Inventors: Michael D. Dolson, Brockville; Tibor Maknyik, Richmond Hill, both of Canada

[73] Assignee: Black & Decker Inc., Newark, Del.

[21] Appl. No.: 112,026

[22] Filed: Aug. 26, 1993

[51] Int. Cl.[5] ..... H01R 13/56

[52] U.S. Cl. ..... 439/447; 439/445

[58] Field of Search ..... 439/445, 447

[56] References Cited

U.S. PATENT DOCUMENTS

| | | |
|---|---|---|
| D. 210,021 | 1/1968 | Prifogle et al. . |
| 2,727,088 | 12/1955 | Wall . |
| 3,032,737 | 5/1962 | Rottmann . |
| 3,093,432 | 6/1963 | King . |
| 3,395,244 | 7/1968 | Koehler . |
| 3,497,608 | 2/1970 | Elliott . |
| 3,721,939 | 3/1973 | Paugh . |
| 3,800,068 | 3/1974 | Torgerson . |
| 3,986,765 | 10/1976 | Shaffer et al. . |
| 4,703,989 | 11/1987 | Price et al. . |
| 5,030,135 | 7/1991 | Plesinger . |
| 5,100,341 | 3/1992 | Czyz . |
| 5,170,016 | 12/1992 | Liu et al. . |
| 5,238,419 | 8/1993 | Roeder et al. ..... 439/447 X |

*Primary Examiner*—Eugene F. Desmond
*Attorney, Agent, or Firm*—Barry E. Deutsch

[57] ABSTRACT

An anti-kink control for an electric cord wherein the cord has relatively flat top and bottom surfaces and relatively round side surfaces. The anti-kink control includes a series of washers assembled on the cord in closely spaced co-axial relation. A first pair of washers are joined by a first axially extending finger along each side of the cord. A next washer adjacent to one of the pair of washers is joined to the one of the pair of washers by a second axially extending finger along the top and bottom surfaces of said cord. The assembled washers form a sleeve about the cord. The space along the side surfaces between adjacent washers joined along the top and bottom surfaces is relatively larger than the space along the top and bottom surfaces between adjacent washers joined along the side surfaces.

9 Claims, 1 Drawing Sheet

ANTI-KINK CONTROL FOR ELECTRICAL CORDS

BACKGROUND OF THE INVENTION

This invention relates to an anti-kink control for an electric cord and in particular to an anti-kink control for an electric cord having flat top and bottom surfaces.

The use of high temperature, flame retardant, electrical cord or cable on small appliances such as electric skillets, kettles and the like is required by both the U.L. in the United States and the C.S.A. in Canada. One type of electric cord that has found acceptability by both the U.L. and C.S.A. for high temperature, flame retardant applications is identified as HPN grade heater cord. The elastomeric insulating jacket of the cord is extruded over the cord's conductors. The three conductive wires of the cord are positioned in the same vertical plane and lie parallel to each other. HPN grade heater cord has generally flat top and bottom surfaces and rounded side surfaces. The flat electrical cord having an HPN insulating jacket, can readily flex in directions that are vertically upward or downward relative to the flat surfaces. However, the cable does not readily flex when moved in a horizontal plane in a direction that is generally 90° to the longitudinal axis of the cable. In most instances with anti-kink devices presently available, a cord when flexed in a horizontal plane, 90° to its longitudinal axis, will develop a sharp bend or radius causing stress on the electrically conductive wires passing through the cord. This stress will eventually result in fatigue of the wires causing premature failure of the cord.

The present invention overcomes the foregoing problem by enabling a flat electric cord to be flexed both vertically upwardly and downwardly and also in a horizontal plane 90° relative to the longitudinal axis of the cord. The durability of the electrical cord has been improved. In the prior art, the cord would fail after 5,000 flexes with a one quarter pound load on the cord. Utilization of the present invention enables the cord to withstand in excess of 10,000 flexes with a one pound load.

As a secondary benefit, since the anti-kink control is molded integral with the jacket of the electrical cord, the anti-kink control also functions as a strain relief for the electric cord.

It is accordingly an object of this invention to form an anti-kink control for an electric cord which effectively enables the cord to be flexed both upwardly and downwardly relative to the top and bottom surfaces thereof and in a horizontal plane 90° relative to the longitudinal axis of the cord.

SUMMARY OF THE INVENTION

The foregoing object and other objects of the invention are achieved in an anti-kink control for an electric cord having relatively flat top and bottom surfaces and relatively round side surfaces and a plug at one end. The anti-kink control includes a series of washers assembled on the cord in closely spaced co-axial relation. A first pair of adjacent washers is joined by a first axially extending finger along each side of the cord. A next washer adjacent to one of the pair of washers is joined to the one of the pair of washers by a second axially extending finger along the top and bottom surfaces of the cord. The assembled washers form a sleeve about the cord. The space along the side surfaces between adjacent washers joined along the top and bottom surfaces is relatively larger than the space along the top and bottom surfaces between adjacent washers joined along the side surfaces.

DESCRIPTION OF THE PREFERRED EMBODIMENT

Figure 1:
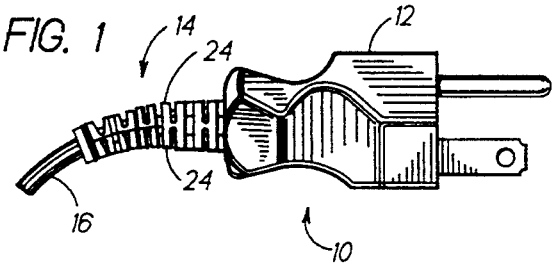
FIG. 1 is a perspective elevational view illustrating the right side of an anti-kink control for an electric cord showing details of the present invention.

Referring now to the various figures of the drawing, there is disclosed a preferred embodiment of the present invention. In referring to the various figures, like numerals shall refer to like parts.

The present invention is embodied in an electric cord 10. Cord 10 comprises a plug 12, the anti-kink control of the present invention 14, and cable 16 which includes an insulating jacket 17 and conductors 18, 20 and 22 shown in FIG. 3. It should be understood that although a male plug 12 is illustrated, anti-kink control 10 may be also used with a female plug. Conductors 18, 20 and 22 lie parallel to each other in the same horizontal plane. Insulating jacket 17 is generally formed from a high temperature, flame retardant material such as HPN grade heater cord. HPN grade heater cord is sold by Victor Electric Wire of West Warwick, R.I. and Ta Hsing Electric Wire and Cable Co. of Tapei Hsien, Taiwan. Electric cord 10 can be used in applications such as electric skillets, kettles and the like wherein the cord must be capable of safely operating at high temperatures and additionally be capable of retarding any flames since the cord is used in appliances typically left in operation by themselves in the kitchen of a home or apartment.

HPN grade insulating jacket 17 has found wide acceptance for use in such applications. The HPN material is extruded about electrical conductors 18, 20 and 22 to form a jacket. The jacket comprises generally flat top and bottom surfaces respectively 34 and 36 and round side surfaces 38 and 40.

Figure 4:
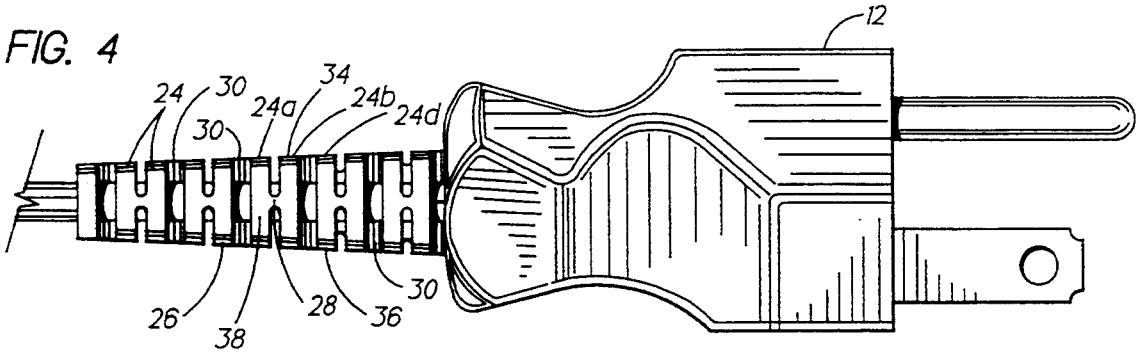
FIG. 4 is an enlarged elevational perspective view of the anti-kink control and adjacent plug.

Anti-kink control 14 comprises a series of washers 24 assembled on the cord in closely spaced co-axial relation. As shown in FIG. 4, a first pair of adjacent washers *24a* and *24b* are joined by a first axially extending finger 28. Finger 28 extends along each side surface 38 and 40 of cord 10. A next washer, for example washer *24c* is joined to one of the pair of washers, for example *24a* by a second axially extending finger 26. Finger 26 extends along the top and bottom surfaces respectively 34 and 36 of anti-kink control 14. Likewise, washer *24d* is connected to washer *24b* by a finger 26. This is particularly shown in FIG. 5.

Figure 5:
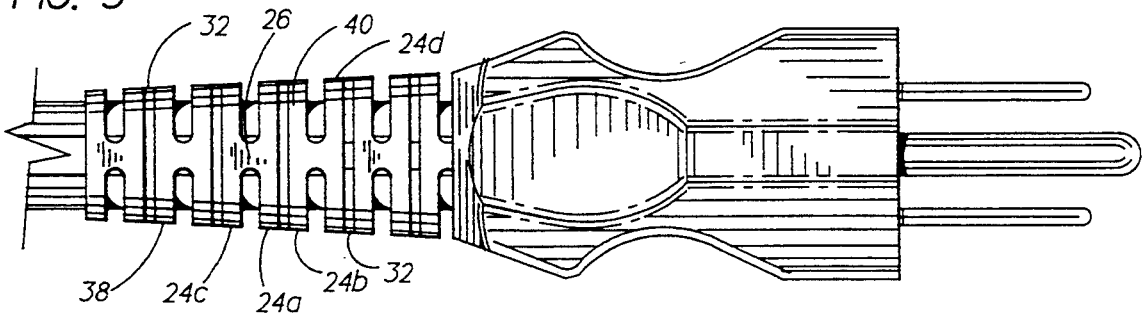
FIG. 5 is an enlarged perspective plan view of the anti-kink control and adjacent plug.

As indicated previously, FIG. 4 illustrates an enlarged side view of the anti-kink control and FIG. 5 illustrates an enlarged top view thereof.

With reference to FIG. 4 it will be noted that a space 30 is formed between each connected pair of washers.

Likewise, a space 32 is formed between each pair of connected washers when anti-kink control 14 is viewed from the top as shown in FIG. 5. Space 30 is significantly larger than space 32. In the preferred embodiment, space 30 is approximately 50% larger than space 32. For example, space 30 may be 1.5 millimeters and space 32 may be 1 millimeter.

Again, as particularly illustrated in FIGS. 4 and 5, the diameter of the washers adjacent plug 12 is greater than the diameter of the washers farther away from the plug. The diameter of the washers taper radially inwardly from the washer adjacent plug 12 axially along the cord to the last washer forming anti-kink control 14.

Preferably, the series of washers 24 forming anti-kink control 14 is molded integrally with plug 12 of cord 10. The series of washers forms an integral sleeve.

It has been found that anti-kink control 14 enables the cord 10 to be flexed upwardly and downwardly relative to flat surfaces 34 and 36 forming the top and bottom of the cord. Generally, most electrical cords can readily flex in these directions. However, the cord does not readily flex in a direction that is in a horizontal plane substantially 90° relative to the longitudinal axis of the cord. In most instances with anti-kink devices that are presently available a cord when flexed in a horizontal plane 90° relative to its longitudinal axis, will develop a sharp bend or radius resulting in stress on the electrically conductive wires passing through the insulating jacket of the cord.

Figure 2:
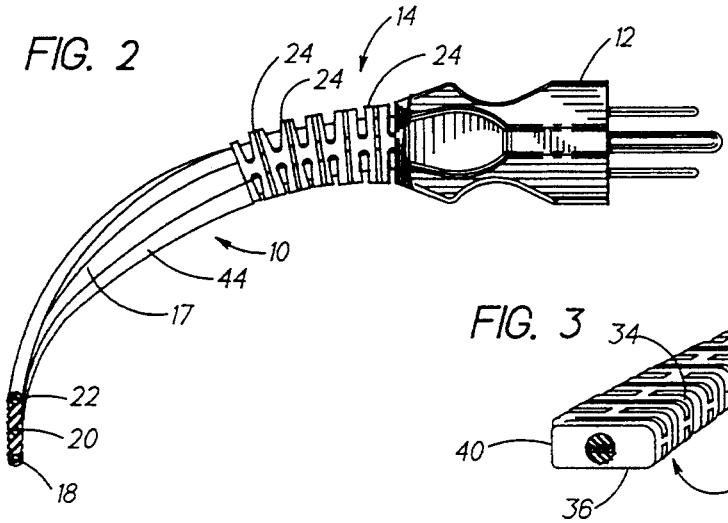
FIG. 2 is a perspective top plan view of the cord and anti-kink control illustrated in FIG. 1.
Figure 3:
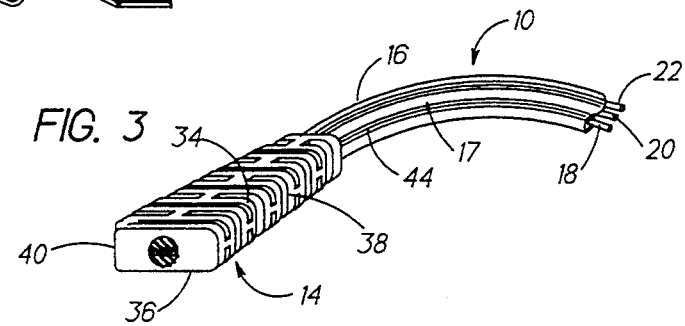
FIG. 3 is a somewhat perspective view of the anti-kink control illustrating the electric conductors of the electrical cord and the cord flexed in a horizontal plane substantially 90° to its longitudinal axis.

FIGS. 2 and 3 illustrate flexing of cord 10 in a horizontal plane and in a direction 90° relative to the longitudinal axis when the anti-kink control 14 of the present invention is utilized. It will be noted that radius 44 of cord 10 which is formed when the cord is flexed as described is relatively large which will reduce the stress on conductive wires 18, 20 and 22 contained within jacket 17. Space 30 along the side surfaces 38, 40 between adjacent washers **24*c* and 24*a* or 24*b* and 24*d* is considerably larger when compared to space 32 along top and bottom surfaces 34, 36 between adjacent washers 24*a* and 24*b* enabling the cord to flex as illustrated in FIGS. 2 and 3**.

The specific male plug illustrated herein is the subject of a co-pending U.S. patent application Ser. No. 29/012,180, filing date Aug. 26, 1993, in the names of the inventors hereof. Likewise a suitable female plug which may be used with anti-kink control 14 is also the subject of a co-pending U.S. design patent application Ser. No. 29/012,189, filing date Aug. 26, 1993, in the names of the inventors hereof.

While a preferred embodiment of the present invention has been described and illustrated, the invention should not be limited thereto but may be otherwise embodied within the scope of the following claims:

What is claimed is:

1. An anti-kink control for an electric cord having relatively flat top and bottom surfaces and relatively round side surfaces and a plug at one end, said anti-kink control comprising:

a series of washers assembled on said cord in closely spaced co-axial relation, a first pair of adjacent washers being joined by a first axially extending finger along each side of said cord and a next washer adjacent to one of the pair of washers being joined to the one of the pair of washers by a second axially extending finger along the top and bottom surfaces of said cord, said assembled washers together forming a sleeve about said cord, the space along the side surfaces between adjacent washers joined along the top and bottom surfaces is relatively larger than the space along the top and bottom surfaces between adjacent washers joined along the side surfaces.

2. An anti-kink control in accordance with claim 1 wherein the series of washers tapers radially inward from the washer adjacent the plug axially along the cord to the last washer forming said sleeve.

3. An anti-kink control in accordance with claim 2 wherein the series of washers is molded integrally with the plug and cord.

4. An anti-kink control in accordance with claim 3 wherein the space along the side surfaces between adjacent washers joined along the top and bottom surfaces is substantially 50% larger than the space along the top and bottom surfaces between adjacent washers joined along the side surfaces.

5. An anti-kink control in accordance with claim 1 wherein the space along the side surfaces between adjacent washers joined along the top and bottom surfaces is substantially 50% larger than the space along the top and bottom surfaces between adjacent washers joined along the side surfaces.

6. An anti-kink control in accordance with claim 2 wherein the space along the side surfaces between adjacent washers joined along the top and bottom surfaces is substantially 50% larger than the space along the top and bottom surfaces between adjacent washers joined along the side surfaces.

7. An anti-kink control in accordance with claim 1 wherein the series of washers is molded integrally with the plug and cord.

8. An anti-kink control in accordance with claim 1 wherein the plug is a male plug.

9. An anti-kink control in accordance with claim 1 wherein the plug is a female plug.

* * * * *